US012486665B2

(12) United States Patent
Schneider

(10) Patent No.: US 12,486,665 B2
(45) Date of Patent: Dec. 2, 2025

(54) INSULATED PANELS AND METHODS OF ENHANCING THERMAL INSULATION OF STRUCTURES USING SAME

(71) Applicant: Sustained Ability Construction LLC, Batavia, IL (US)

(72) Inventor: Craig Schneider, Batavia, IL (US)

(73) Assignee: Sustained Ability Construction LLC, Batavia, IL (US)

( * ) Notice: Subject to any disclaimer, the term of this patent is extended or adjusted under 35 U.S.C. 154(b) by 299 days.

(21) Appl. No.: 17/945,083

(22) Filed: Sep. 15, 2022

(65) Prior Publication Data

US 2023/0175259 A1 Jun. 8, 2023

Related U.S. Application Data

(60) Provisional application No. 63/244,242, filed on Sep. 15, 2021.

(51) Int. Cl.

| | |
|---|---|
| ***E04C 2/292*** | (2006.01) |
| ***E04B 1/64*** | (2006.01) |
| ***E04B 1/80*** | (2006.01) |
| ***E04B 2/00*** | (2006.01) |
| ***E04C 2/16*** | (2006.01) |

(52) U.S. Cl.

CPC ..... *E04C 2/292* (2013.01); *E04B 1/64* (2013.01); *E04B 1/80* (2013.01); *E04C 2/16* (2013.01); *E04C 2/46* (2013.01); *E04B 2103/04* (2013.01)

(58) Field of Classification Search

CPC ... E04C 2/292; E04C 2/16; E04C 2/46; E04B 1/64; E04B 1/80; E04B 2103/04; E04B 2/707

See application file for complete search history.

(56) References Cited

U.S. PATENT DOCUMENTS

| | | | | |
|---|---|---|---|---|
| 4,351,873 | A * | 9/1982 | Davis | E04B 1/80 428/317.1 |
| 8,789,329 | B2 * | 7/2014 | Radoane | E04B 2/88 52/746.1 |
| 8,806,825 | B2 * | 8/2014 | Egan | E04F 13/045 52/302.1 |
| 8,898,981 | B2 * | 12/2014 | Egan | E04B 1/644 52/302.1 |
| 9,091,072 | B2 * | 7/2015 | Egan | E04B 1/62 |
| 9,194,131 | B2 * | 11/2015 | Egan | E04B 1/64 |
| 9,228,348 | B2 * | 1/2016 | Radoane | E04B 2/88 |
| 9,458,618 | B1 * | 10/2016 | Woznuk | E04B 1/0007 |

(Continued)

OTHER PUBLICATIONS

Huber Engineered Woods LLC, "ZipSystem™ R-Sheathing" (Dec. 2020), 2 pages.

(Continued)

*Primary Examiner* — Rodney Mintz

(74) *Attorney, Agent, or Firm* — INCUBATE IP; Randy R. Micheletti

(57) ABSTRACT

The present disclosure provides insulated panels comprising a core layer including an insulating material, an interior-side sheathing layer, and an exterior-side sheathing layer. The insulated panels of the present disclosure can be used to conveniently retrofit existing structures to dramatically improve thermal insulation performance without substantially increasing a risk of moisture retention or mold formation within the structure's walls.

13 Claims, 12 Drawing Sheets

(56) References Cited

U.S. PATENT DOCUMENTS

| | | | | |
|---|---|---|---|---|
| 9,458,631 | B2 * | 10/2016 | Radoane | E04B 1/7625 |
| 9,624,666 | B2 * | 4/2017 | Singleton | E04C 2/46 |
| 10,227,773 | B2 * | 3/2019 | Radoane | E04F 13/04 |
| 10,760,270 | B2 * | 9/2020 | Singleton | E04C 2/521 |
| 11,028,578 | B2 * | 6/2021 | Cullen | B32B 21/10 |
| 11,702,856 | B2 * | 7/2023 | White | F41H 5/013 52/506.01 |
| 11,851,877 | B2 * | 12/2023 | Mort | E04B 1/7641 |
| 11,913,227 | B2 * | 2/2024 | Leahy | B32B 13/10 |
| 12,129,648 | B2 * | 10/2024 | Espada | E04C 2/24 |
| 12,129,652 | B2 * | 10/2024 | Malinowski | E04C 2/38 |
| 2009/0098357 | A1 * | 4/2009 | Bergtold | B32B 7/02 428/218 |
| 2011/0197528 | A1 * | 8/2011 | Egan | E04B 1/62 52/309.3 |
| 2011/0258944 | A1 * | 10/2011 | Radoane | E04B 1/665 52/220.8 |
| 2011/0296781 | A1 * | 12/2011 | McCary | E04C 2/292 52/302.1 |
| 2013/0008099 | A1 * | 1/2013 | Toorell | E04B 1/762 52/169.11 |
| 2013/0305643 | A1 * | 11/2013 | Singleton | E04C 2/284 52/404.1 |
| 2014/0075872 | A1 * | 3/2014 | Mercado | E04B 2/58 52/309.9 |
| 2014/0096460 | A1 * | 4/2014 | Toorell | E04B 1/7645 52/169.11 |
| 2014/0182221 | A1 * | 7/2014 | Hicks | E04B 1/80 52/169.11 |
| 2014/0298744 | A1 * | 10/2014 | Radoane | E04B 1/6803 52/411 |
| 2014/0311069 | A1 * | 10/2014 | Egan | E04F 13/047 52/309.3 |
| 2014/0373474 | A1 * | 12/2014 | Egan | E04B 1/64 52/741.41 |
| 2015/0047816 | A1 * | 2/2015 | Radoane | F28F 13/04 165/135 |
| 2015/0225961 | A1 * | 8/2015 | Egan | E04B 1/66 52/447 |
| 2015/0292196 | A1 * | 10/2015 | Radoane | E04B 2/58 52/62 |
| 2016/0305120 | A1 * | 10/2016 | Radoane | H02G 3/36 |
| 2017/0022682 | A1 * | 1/2017 | Hicks | E04B 1/72 |
| 2017/0210098 | A1 * | 7/2017 | Moore | B32B 21/10 |
| 2017/0234008 | A1 * | 8/2017 | Singleton | E04C 2/284 52/220.1 |
| 2018/0080223 | A1 * | 3/2018 | Grant | E04B 1/7662 |
| 2020/0232208 | A1 * | 7/2020 | Cullen | B32B 27/065 |
| 2020/0399899 | A1 * | 12/2020 | Singleton | E04C 2/46 |
| 2021/0140189 | A1 * | 5/2021 | White | E04H 9/16 |
| 2021/0301526 | A1 * | 9/2021 | Leahy | B32B 13/04 |
| 2022/0090377 | A1 * | 3/2022 | Espada | E04B 2/58 |
| 2022/0136229 | A1 * | 5/2022 | Tompane | E04B 1/2612 52/633 |
| 2022/0136241 | A1 * | 5/2022 | Tompane | E04B 1/2612 52/653.1 |
| 2022/0154467 | A1 * | 5/2022 | Mort | E04B 1/14 |
| 2022/0205242 | A1 * | 6/2022 | Malinowski | E04C 2/322 |
| 2023/0160206 | A1 * | 5/2023 | Cullen | B32B 21/02 52/220.1 |
| 2023/0392373 | A1 * | 12/2023 | Tompane | E04B 2/707 |
| 2024/0076870 | A1 * | 3/2024 | Singleton | E04C 2/521 |
| 2024/0175264 | A1 * | 5/2024 | Mort | B32B 3/30 |
| 2024/0308173 | A1 * | 9/2024 | Johnson | E04B 1/942 |
| 2024/0344321 | A1 * | 10/2024 | Mrak, III | E04B 1/665 |
| 2025/0122721 | A1 * | 4/2025 | Yamaguchi | E04B 1/642 |

OTHER PUBLICATIONS

Lstiburek, "Insight: Confusion About Diffusion," available at www.buildingscience.com (May 2011), 6 pages.
OwensCorning Foam Insulation, LLC, Formular 150 Product Data Sheet (Sep. 2011), 4 pages.
Prosoco, R-Guard® Cat 5™ Product Data Sheet (date unknown), 6 pages.
Prosoco, R-Guard® FastFlash™ Product Data Sheet (date unknown), 6 pages.
Prosoco, R-Guard® Joint & Seam Filler Product Data Sheet (date unknown), 6 pages.
Rashkin, "New Business Opportunity: Existing Home Service Center," Better Buildings Better Business Conference (Mar. 10, 2020), 41 pages.
Rockwool, Comfortbatt® Thermal Batt Insulation Technical Data Sheet (Aug. 1, 2020), 2 pages.
Rockwool, "ComfortBoard™ Cladding Attachment and Support" (date unknown), 8 pages.
SIPA, "Building with SIPs: Need to Know" (date unknown), 20 pages.
SIPA, "Designing with SIPs: Design Considerations" (date unknown), 20 pages.
SIPA, "General Do's and Don'ts for Handling and Installing SIPs" (date unknown), 2 pages.
SIPA, "Sip Solutions for Commercial Construction," Form No. 04-21 (Sep. 2004), 1 page.
SIPA, "SIP Walls are Engineered to Minimize Thermal Bridging," Form No. L-208 (date unknown), 1 page.
SIPA, "Frequently Asked Questions about Structural Insulated Panels (SIPs)" (date unknown), 11 pages.
SIPA, "Structural Insulated Panels Product Guide" (Jun. 2018), 22 pages.
SIPA, "Retrofit Insulated Wall & Roof Panel Installation Guide" (Aug. 2015), 40 pages.
SIPA, "Sip Design-BP 1: High-Performance SIP Building Envelope" (date unknown), 24 pages.
SIPA, "Sip Design-BP 2: HVAC Systems with SIPs" (date unknown), 11 pages.
SIPA, "SIP Design-BP 3: SIP Structural Capabilities" (date unknown), 14 pages.
SIPA, "Sip Design-BP 4: SIP Sizes" (date unknown), 6 pages.
SIPA, "Structural Insulated Panels: Guide Specification" (Jan. 12, 2021), 10 pages.
SIPA, "SIPs Cut Labor Costs by 55%" (date unknown), 2 pages.
SIPA, "SIPA Best Program Study Guide" (date unknown), 38 pages.
SIPA, "Cold Climate Retrofit" (2013), 1 page.
Straube, "BSD-163: Controlling Cold-Weather Condensation Using Insulation," available at https://www.buildingscience.com/documents/digests/bsd-controlling-cold-weather-condensation-using-insulation (Nov. 2011), 10 pages.
The John C. Stennis Institute of Government, "Housing Strategies for Mississippi: Briefing Paper" (Apr. 8, 2006), 16 pages.
TimberHP by GO Lab, "TimberBoard by TimberHP: Product Data Sheet" (Aug. 2022), 1 page.
Ueno, "Monitoring of Double-Stud Wall Moisture Conditions in the Northeast" (Jan. 2015), 36 pages.

* cited by examiner (not to scale)

INSULATED PANELS AND METHODS OF ENHANCING THERMAL INSULATION OF STRUCTURES USING SAME

PRIORITY CLAIM

This application claims priority to U.S. Provisional Patent Application Ser. No. 63/244,242, filed Sep. 15, 2021, the entirety of which is incorporated herein by reference and relied upon.

FIELD OF THE INVENTION

The present disclosure provides insulated panels comprising a plurality of layers. In some embodiments, the insulated panels are configured to be disposed adjacent to (e.g., in contact with) the exterior-facing surface (e.g., exterior-exposed surface) of a structure's wall.

BACKGROUND

Common methods for enhancing thermal insulation of a structure generally include increasing the amount (e.g., thickness or density) of thermal insulation material within the structure's walls, replacing existing thermal insulation with higher-performing thermal insulation materials, or a combination thereof. However, increasing or replacing the existing thermal insulation requires the structure's walls to be partially demolished in order to access the installation location. This process is time consuming, costly and requires existing finished wall surfaces to be removed and replaced.

There remains a need to economically and efficiently upgrade insulation performance without also detrimentally impacting a building's purpose and its occupants' health or financial well-being.

SUMMARY

The present disclosure provides insulated panels comprising a plurality of layers.

In one embodiment, the present disclosure provides an insulated panel 10 comprising: a core layer 400 comprising thermal insulation; an exterior layer 500 comprising sheathing; and an interior layer 700 disposed opposite the exterior layer and comprising sheathing.

In another embodiment, the present disclosure provides an insulated panel 10 comprising: an external frame 100; a thermal insulation 400 disposed within the external frame 100; a first sheathing layer 700 disposed on an interior face of the insulated panel; a second sheathing layer 500 disposed on an exterior face of the insulated panel; and a water-resistant barrier layer 600 disposed on the second sheathing layer opposite the first sheathing layer.

In another embodiment, the present disclosure provides an insulating core-shell construction panel comprising: a core 200,300,410 comprising thermal insulation component 410 and an internal frame component 200,300 dispersed throughout the thermal insulation component; and a shell surrounding the core and comprising: an external frame 100 surrounding a perimeter of the core and having an external face and an internal face opposite the external face, an external sheathing layer 500 disposed on the external face of the external frame, and an internal sheathing layer 700 disposed on the internal face of the external frame.

In other embodiments, the present disclosure provides a method of enhancing thermal insulation performance of a wall, the method comprising: removing an exterior siding layer and associated furr strips, if present, to expose an existing exterior sheathing layer of the wall; attaching an insulated panel 10 or an insulating core-shell construction panel 10 as disclosed herein to the existing exterior sheathing of the wall; and attaching an exterior siding layer to an exterior surface of the insulated panel or the insulating core-shell construction panel.

These and other embodiments are described in greater detail herein with reference to the Figures.

BRIEF DESCRIPTION OF THE FIGURES

FIG. 3B shows a side cross-sectional view of a portion of the insulated panel of FIG. 3A installed around a window opening (WO) of an exterior wall of the representative structure.

While specific embodiments are illustrated in the figures, with the understanding that the disclosure is intended to be illustrative, these embodiments are not intended to limit the invention described and illustrated herein.

DETAILED DESCRIPTION

Generally, the present disclosure provides insulated panels comprising a plurality of layers.

Referring generally to FIGS. 1-10, 13-14 and 16-17, insulated panels 10 consistent with the present disclosure generally include a core layer 400 comprising an insulating material, a first sheathing layer 500 disposed on an exterior face of the core layer 400, and a second sheathing layer 700 disposed on an interior face of the core layer 400.

Figure 1:
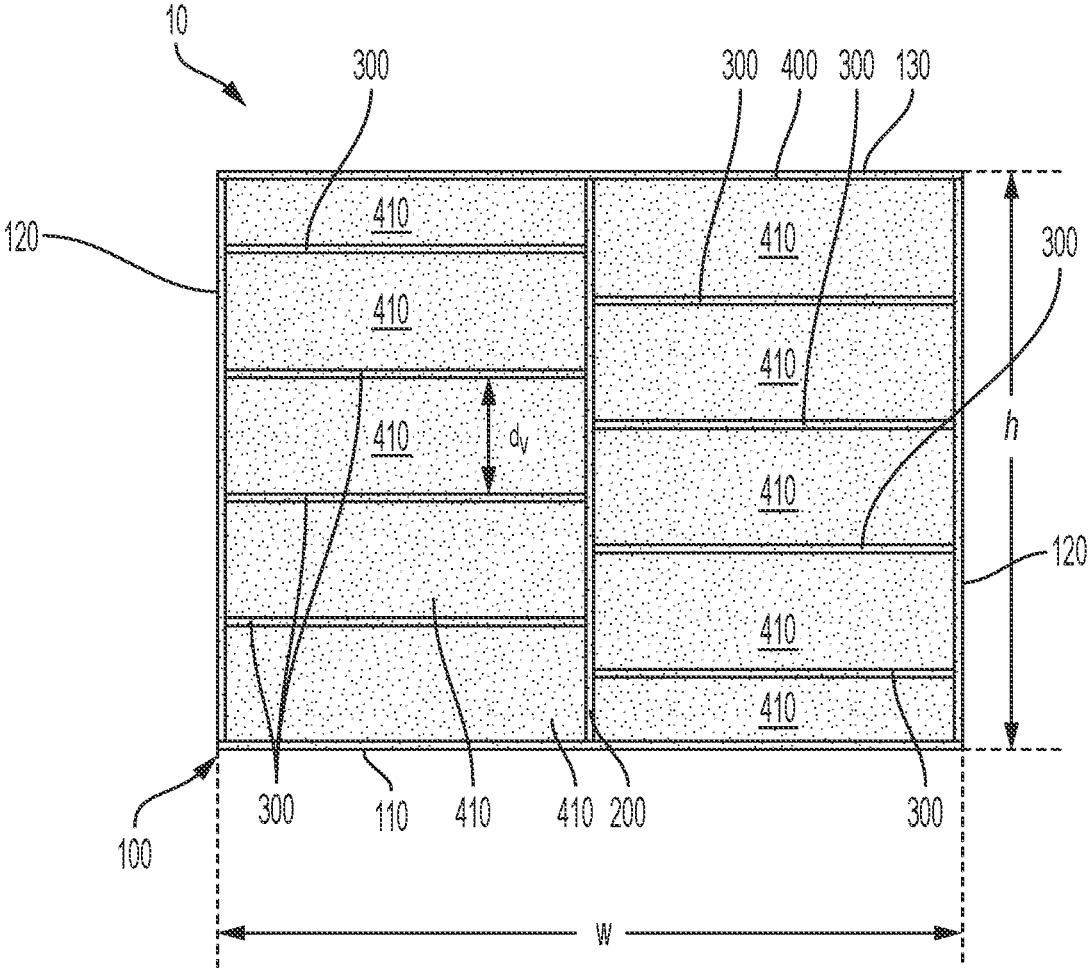
FIG. 1 shows a front view of a portion of an insulated panel consistent with one embodiment of the present disclosure.
Figure 2:
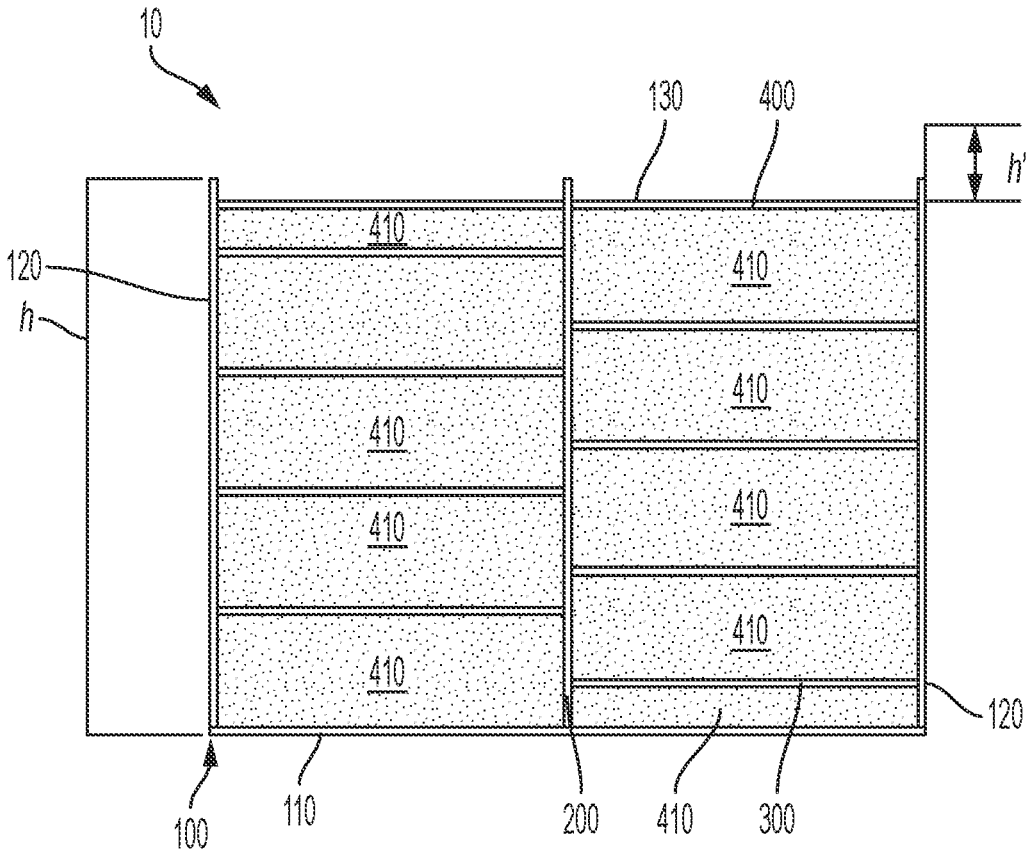
FIG. 2 shows a front view of a portion of an insulated panel consistent with another embodiment of the present disclosure.

Turning now specifically to FIGS. 1-2, an insulated panel 10 consistent with one embodiment of the present disclosure comprises a frame 100 and an insulation material 400 disposed within the frame 100.

The frame 100 may include a bottom frame member 110, a first vertical frame member 120 disposed at one end of the bottom frame member 110, a second vertical frame member 120 disposed at the opposite end of the bottom frame member 110, and a top frame member 130 disposed opposite the bottom frame member 110. In some embodiments, such as those consistent with FIG. 2, one or more of the vertical frame members 120 may have a height (h+h') that extends by a distance h' beyond the height h of the insulated panel 10. The additional vertical height h' of the vertical frame member(s) 120 in such embodiments may be desirable, for example to join with a channel OHC in an overhead soffit OHS.

The frame 100 may have a height h and width w configured for convenient transport to and/or installation on an existing structure. For example and without limitation, the frame 100 may have a height h of about 4 feet to about 12 feet, for example about 4 feet to about 12 feet, about 5 feet to about 10 feet, or about 6 feet to about 9 feet. In some embodiments, the frame 100 has a height h of about 4 feet, about 4.1 feet, about 4.2 feet, about 4.3 feet, about 4.4 feet, about 4.5 feet, about 4.6 feet, about 4.7 feet, about 4.8 feet, about 4.9 feet, about 5 feet, about 5.1 feet, about 5.2 feet, about 5.3 feet, about 5.4 feet, about 5.5 feet, about 5.6 feet, about 5.7 feet, about 5.8 feet, about 5.9 feet, about 6 feet, about 6.1 feet, about 6.2 feet, about 6.3 feet, about 6.4 feet, about 6.5 feet, about 6.6 feet, about 6.7 feet, about 6.8 feet, about 6.9 feet, about 7 feet, about 7.1 feet, about 7.2 feet, about 7.3 feet, about 7.4 feet, about 7.5 feet, about 7.6 feet, about 7.7 feet, about 7.8 feet, about 7.9 feet, about 8 feet, about 8.1 feet, about 8.2 feet, about 8.3 feet, about 8.4 feet, about 8.5 feet, about 8.6 feet, about 8.7 feet, about 8.8 feet, about 8.9 feet, about 9 feet, about 9.1 feet, about 9.2 feet, about 9.3 feet, about 9.4 feet, about 9.5 feet, about 9.6 feet, about 9.7 feet, about 9.8 feet, about 9.9 feet, about 10 feet, about 10.1 feet, about 10.2 feet, about 10.3 feet, about 10.4 feet, about 10.5 feet, about 10.6 feet, about 10.7 feet, about 10.8 feet, about 10.9 feet, about 11 feet, about 11.1 feet, about 11.2 feet, about 11.3 feet, about 11.4 feet, about 11.5 feet, about 11.6 feet, about 11.7 feet, about 11.8 feet, about 11.9 feet, or about 12 feet.

The frame 100 may have a width w of about 6 feet to about 16 feet, for example about 8 feet to about 14 feet, or about 10 feet to about 12 feet. In some embodiments, the frame 100 has a width w of about 6 feet, about 6.1 feet, about 6.2 feet, about 6.3 feet, about 6.4 feet, about 6.5 feet, about 6.6 feet, about 6.7 feet, about 6.8 feet, about 6.9 feet, about 7 feet, about 7.1 feet, about 7.2 feet, about 7.3 feet, about 7.4 feet, about 7.5 feet, about 7.6 feet, about 7.7 feet, about 7.8 feet, about 7.9 feet, about 8 feet, about 8.1 feet, about 8.2 feet, about 8.3 feet, about 8.4 feet, about 8.5 feet, about 8.6 feet, about 8.7 feet, about 8.8 feet, about 8.9 feet, about 9 feet, about 9.1 feet, about 9.2 feet, about 9.3 feet, about 9.4 feet, about 9.5 feet, about 9.6 feet, about 9.7 feet, about 9.8 feet, about 9.9 feet, about 10 feet, about 10.1 feet, about 10.2 feet, about 10.3 feet, about 10.4 feet, about 10.5 feet, about 10.6 feet, about 10.7 feet, about 10.8 feet, about 10.9 feet, about 11 feet, about 11.1 feet, about 11.2 feet, about 11.3 feet, about 11.4 feet, about 11.5 feet, about 11.6 feet, about 11.7 feet, about 11.8 feet, about 11.9 feet, about 12 feet, about 12.1 feet, about 12.2 feet, about 12.3 feet, about 12.4 feet, about 12.5 feet, about 12.6 feet, about 12.7 feet, about 12.8 feet, about 12.9 feet, about 13 feet, about 13.1 feet, about 13.2 feet, about 13.3 feet, about 13.4 feet, about 13.5 feet, about 13.6 feet, about 13.7 feet, about 13.8 feet, about 13.9 feet, about 14 feet, about 14.1 feet, about 14.2 feet, about 14.3 feet, about 14.4 feet, about 14.5 feet, about 14.6 feet, about 14.7 feet, about 14.8 feet, about 14.9 feet, about 15 feet, about 15.1 feet, about 15.2 feet, about 15.3 feet, about 15.4 feet, about 15.5 feet, about 15.6 feet, about 15.7 feet, about 15.8 feet, about 15.9 feet, or about 16 feet.

The frame 100 may comprise, consist essentially of, or consist of any suitable material. For example and without limitation, the frame 100 may be formed of wood, steel, aluminum, tin, or any combination thereof. In some embodiments, the frame 100 is formed of construction-grade materials, such as framing timbers (e.g., 2×2 lumber, 2×3 lumber, 2×4 lumber, 2×4 steel studs, 2×6 lumber, 2×8 lumber, etc.).

The core layer 400 is generally disposed within the frame 100 and is configured to provide thermal insulation properties to the insulated panel 10. In some embodiments, the core layer 400 includes thermal insulation 410. The thermal insulation 410 may comprise, consist essentially of, or consist of any suitable thermal insulation material or combination of materials. In some embodiments, the thermal insulation 410 comprises, consists essentially of, or consists of extruded polystyrene (also referred to as XPS). In some embodiments, the thermal insulation 410 comprises, consists essentially of, or consists of spray foam. In some embodiments, the thermal insulation 410 comprises, consists essentially of, or consists of stone wool batt (e.g., rockwool). In some embodiments, the thermal insulation 41 comprises, consists essentially of, or consists of woodfiber insulation batt. In some embodiments, the thermal insulation 410 comprises, consists essentially of, or consists of a combination of any two or more of: extruded polystyrene, spray foam, woodfiber insulation batts, and stone wool batt.

In some embodiments, the core layer 400 includes a single section of the thermal insulation 410. In other embodiments, the core layer 400 includes a plurality of thermal insulation sections 410. For example and without limitation, the core layer 400 may include at least 2 thermal insulation sections 410, such as 2 thermal insulation segments 410, 3 thermal insulation segments 410, 4 thermal insulation segments 410, 5 thermal insulation segments 410, 6 thermal insulation segments 410, 7 thermal insulation segments 410, 8 thermal insulation segments 410, 9 thermal insulation segments 410, 10 thermal insulation segments 410, 11 thermal insulation segments 410, 12 thermal insulation segments 410, 13 thermal insulation segments 410, 14 thermal insulation segments 410, 15 thermal insulation segments 410, 16 thermal insulation segments 410, 17 thermal insulation segments 410, 18 thermal insulation segments 410, 19 thermal insulation segments 410, 20 thermal insulation segments 410, or more than 20 thermal insulation segments 410.

In embodiments wherein the core layer 400 includes a plurality of thermal insulation segments 410, the segments may be separated by internal frame members 200,300. In some embodiments, the internal frame members include at least one vertical internal frame member 200 oriented generally parallel to the vertical frame members 120 (when present) or generally anti-parallel to the bottom frame member 110 (when present). In some embodiments, the internal frame members include at least one horizontal internal frame member 300 oriented generally parallel to the bottom frame member 110 (when present) or generally anti-parallel to the vertical frame members 120 (when present). In some embodiments, the internal frame members are oriented on a non-right angle relative to the bottom frame member 120 (when present) or to the vertical frame members 120 (when present). In some embodiments, the core layer 400 includes a vertical internal frame member 200 disposed substantially midway between a first vertical frame member 120 and a second vertical frame member 120. In some embodiments, the core layer 400 includes at least one horizontal internal frame member 300 spanning the distance between a first vertical frame member 120 and a second vertical frame member 120. In some embodiments, the core layer 400 includes at least one horizontal internal frame member 300 spanning the distance between a first vertical frame member and a vertical internal frame member 200. In some embodiments, the core layer 400 includes a plurality of internal frame members 200,300 that together define a grid pattern in which thermal insulation segments 410 are disposed.

In some embodiments, the plurality of horizontal internal frame members 300 are separated from each other by a vertical distance $d_v$ (e.g., a center-to-center vertical distance) of about 12 inches to about 28 inches, for example about 12 inches, about 12.5 inches, about 13 inches, about 13.5 inches, about 14 inches, about 14.5 inches, about 15 inches, about 15.5 inches, about 16 inches, about 16.5 inches, about 17 inches, about 17.5 inches, about 18 inches, about 18.5 inches, about 19 inches, about 19.5 inches, about 20 inches, about 20.5 inches, about 21 inches, about 21.5 inches, about 22 inches, about 22.5 inches, about 23 inches, about 23.5 inches, about 24 inches, about 24.5 inches, about 25 inches, about 25.5 inches, about 26 inches, about 26.5 inches, about 27 inches, about 27.5 inches, or about 28 inches.

In general, embodiments including a minimal amount of internal frame members 200,300 are preferred to maximize the thermal insulation properties of the insulated panel 10. Without wishing to be bound by theory, it is presently believed that thermal insulation efficiency would be lost (e.g., through thermal conduction) through an insulated panel 10 that includes relatively more internal frame members 200,300 compared to a comparable insulated panel 10 including relatively less internal frame members 200,300. However, the presence of some internal frame members 200,300 has been found to be beneficial in providing the insulated panel 10 with structural integrity for transportation and installation, and also to provide additional anchoring structures for furr strips FS and external decorative materials (e.g., lateral siding LS). In some embodiments, the cross-sectional area represented by the internal frame members 200,300 represents not more than about 20% of the cross-sectional surface area of the core layer 400, such as not more than about 20% of the cross-sectional surface area of the core layer 400, not more than about 19% of the cross-sectional surface area of the core layer 400, not more than about 18% of the cross-sectional surface area of the core layer 400, not more than about 17% of the cross-sectional surface area of the core layer 400, not more than about 16% of the cross-sectional surface area of the core layer 400, not more than about 15% of the cross-sectional surface area of the core layer 400, not more than about 14% of the cross-sectional surface area of the core layer 400, not more than about 13% of the cross-sectional surface area of the core layer 400, not more than about 12% of the cross-sectional surface area of the core layer 400, not more than about 11% of the cross-sectional surface area of the core layer 400, not more than about 10% of the cross-sectional surface area of the core layer 400, not more than about 9% of the cross-sectional surface area of the core layer 400, not more than about 8% of the cross-sectional surface area of the core layer 400, not more than about 7% of the cross-sectional surface area of the core layer 400, not more than about 6% of the cross-sectional surface area of the core layer 400, or not more than about 5% of the cross-sectional surface area of the core layer 400.

Figure 3A:
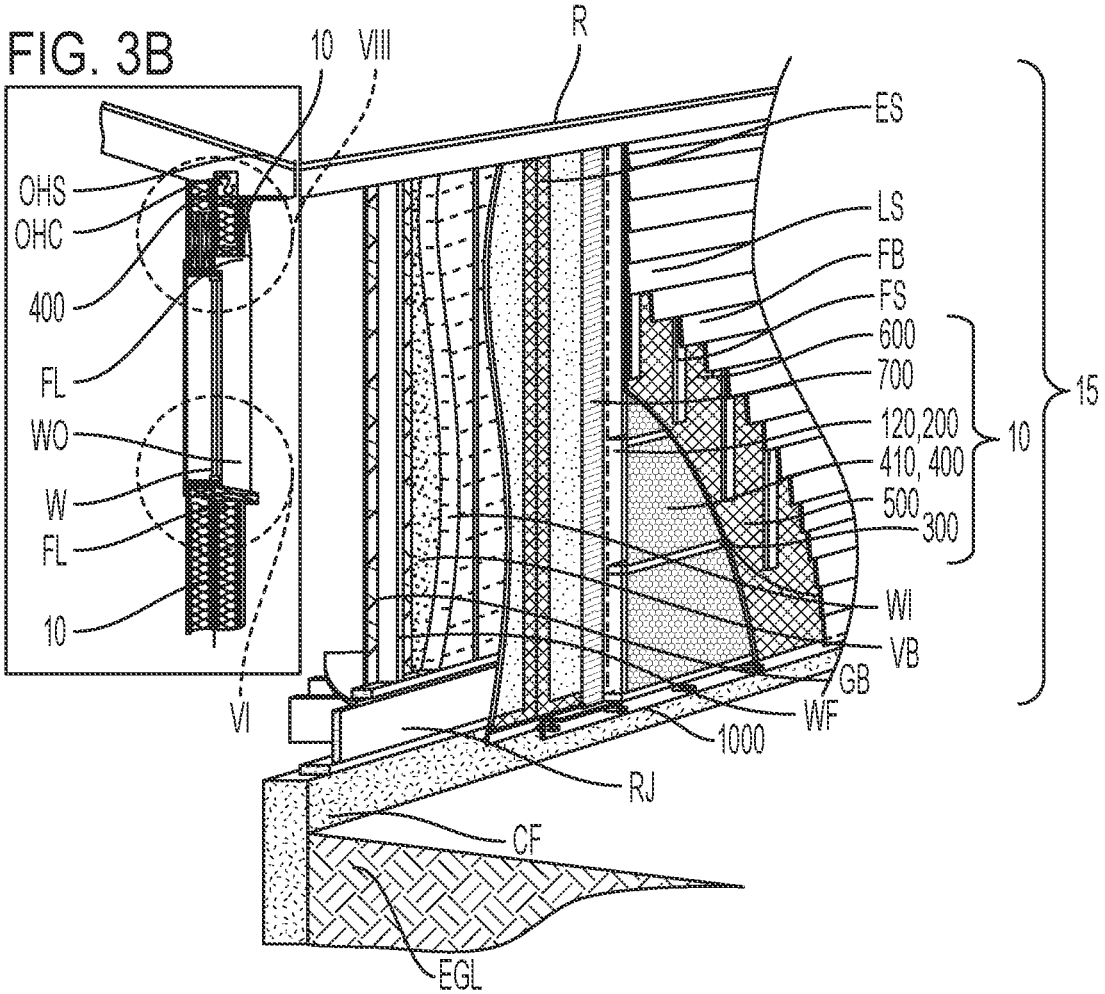
FIG. 3A shows a perspective cutaway view of an insulated panel consistent with one embodiment of the present disclosure installed on an exterior wall of a representative structure.
Figure 4:
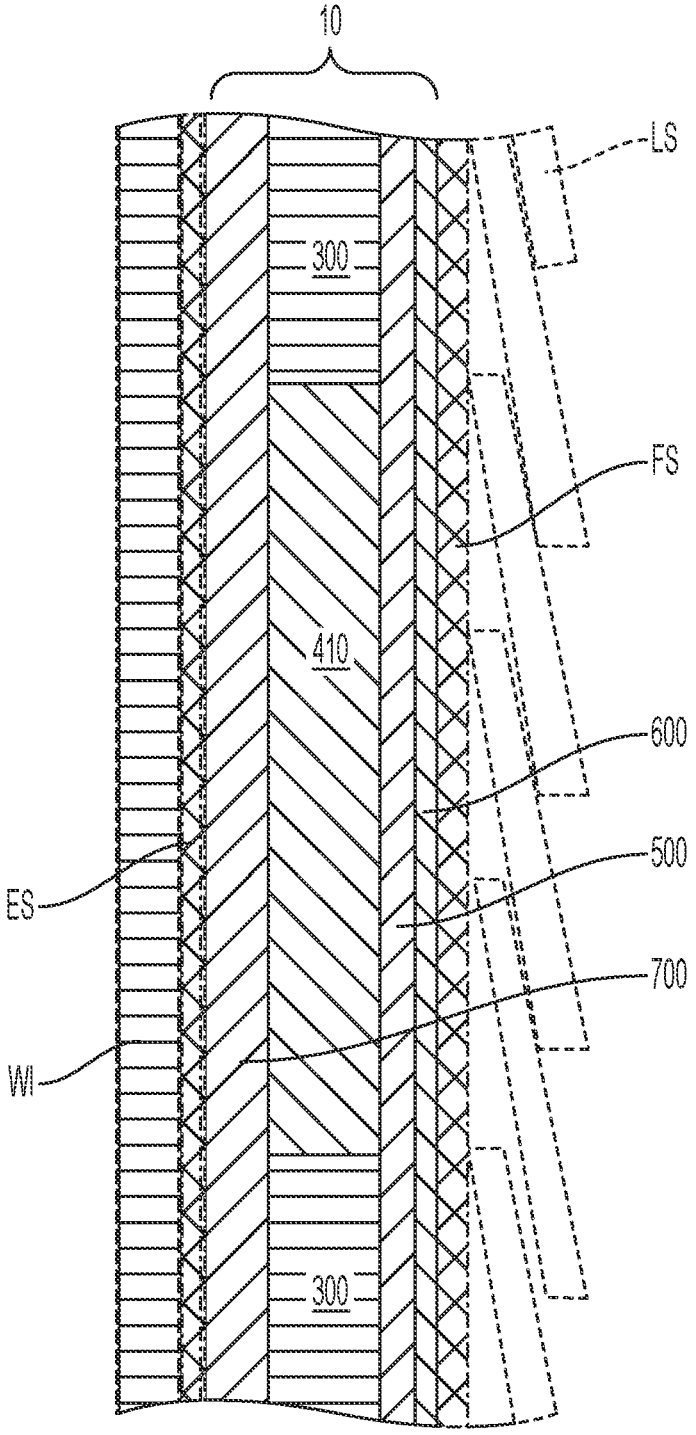
FIG. 4 shows a cross-sectional view of a portion of an insulated panel consistent with one embodiment of the present disclosure.

Referring now to FIGS. 3A-4, insulated panels 10 consistent with the present disclosure may further comprise an exterior sheathing layer 500 disposed on an exterior face of the core layer 400. The exterior sheathing layer 500 may comprise, consist essentially of, or consist of any suitable sheathing material. For example and without limitation, the exterior sheathing layer 500 may comprise, consist essentially of, or consist of structural sheathing such as plywood, pressboard, oriented strand board, gypsum, glass mat, cement board, or long-fibered water- and weather-resistant engineered panels (e.g., THERMO-BRACE, Barricade Building Products). In some embodiments, the exterior sheathing layer 500 has a thickness of about ⅛ inch to about 2 inches, for example about ⅛ inch, about ¼ inch, about ⅜ inch, about ½ inch, about ⅝ inch, about ¾ inch, about ⅞ inch, about 1 inch, about 1⅛ inches, about 1¼ inches, about 1⅜ inches, about 1½ inches, about 1⅝ inches, about 1¾ inches, about 1⅞ inches, or about 2 inches.

Figure 16:
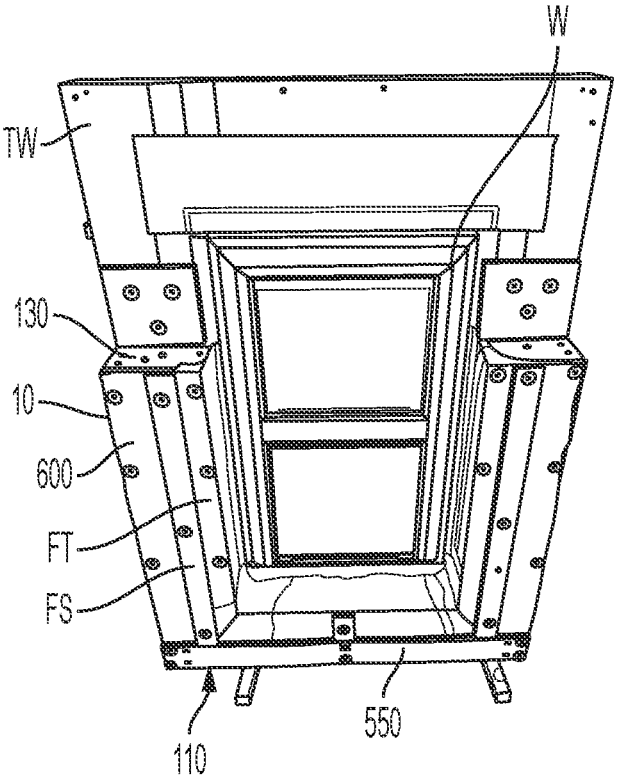
FIG. 16 shows the insulated panel of FIG. 13 installed around the bottom portion of the window shown in FIG. 15.
Figure 17:
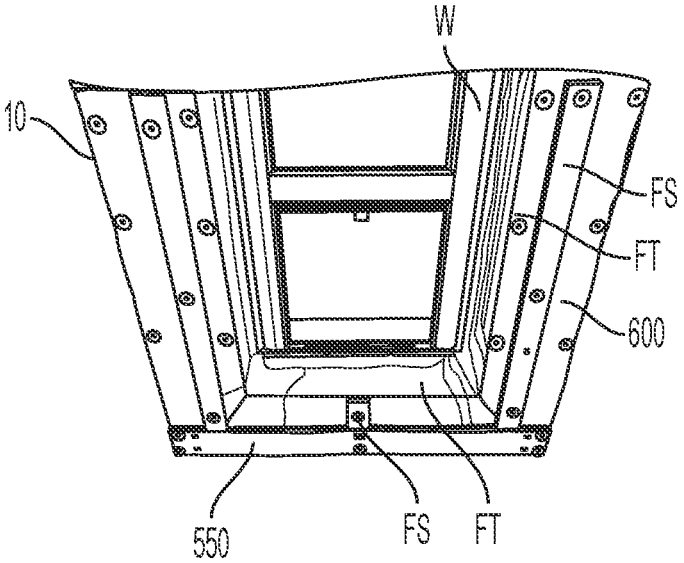
FIG. 17 shows the insulated panel of FIG. 13 including a water-resistant barrier layer.

In some embodiments, such as those shown representatively in FIGS. 16-17, a rainscreen vent 550 may be disposed on the water-resistant barrier layer 600. When present, the rainscreen vent 550 is configured to enable moisture that has seeped into the insulated panel 10—for example moisture that has seeped behind the exterior siding or cladding and into the rainscreen opening area—to dissipate to the exterior environment EE. In some embodiments, the rainscreen vent 550 is disposed near the bottom frame member 110 of the insulated panel 10. In some embodiments, the rainscreen vent 550 is a polypropylene furring strip (e.g., CV-3, Cor-A-Vent, Inc.; Mishawaka, Indiana). In some embodiments, the insulated panel 10 further includes a drainable sheathing portion 710 disposed adjacent to the rainscreen area (e.g., on or partially in place of the interior sheathing layer 700) to preferentially draw water into the insulated panel 10 and away from the exterior sheathing ES of the existing structure to further improve the insulating performance of the wall 15 including the insulated panel 10 compared to the preexisting structure wall without the insulated panel 10.

Figure 7:
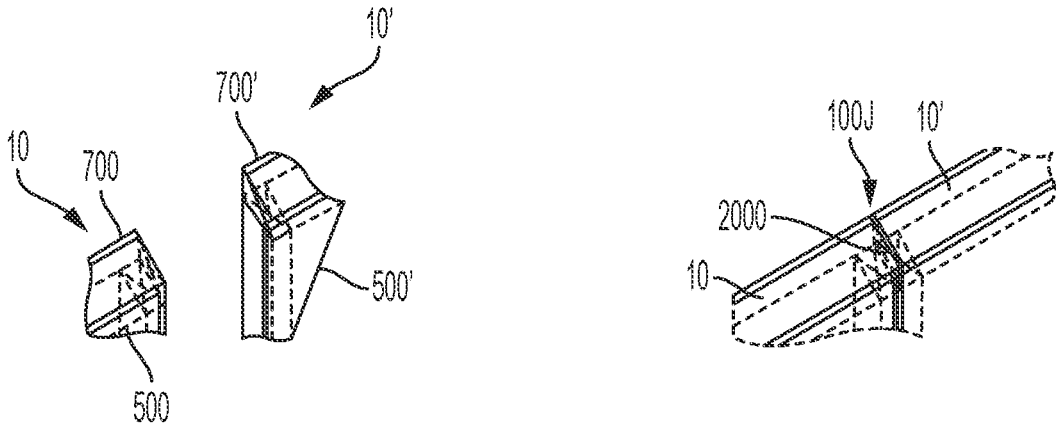
FIG. 7 shows enlarged edge portions of two insulated panels consistent with the present disclosure configured to be installed in contact with each other.
Figure 10:
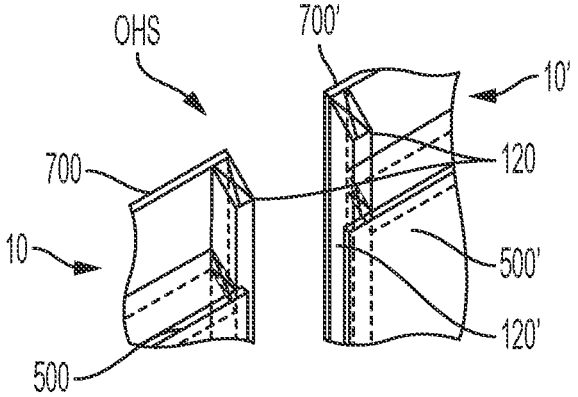
FIG. 10 shows an enlarged portion of two insulated panels consistent with the present disclosure configured to be installed in contact with each other adjacent to an overhang.

Referring now generally to FIGS. 7 and 10, the exterior sheathing layer 500 in some embodiments is offset laterally and/or vertically from the core layer 400 such that the exterior sheathing layer 500 extends beyond the one or more of the vertical frame members 120 and/or beyond the bottom frame member 110 and/or beyond the top frame member 130. In such embodiments, the exterior sheathing layer 500 may have the same or substantially the same width w and height h as the core layer 400. In such embodiments, the insulated panel 10 may be configured to mate with a second insulated layer 10' that includes an exterior sheathing layer 500' that does not extend to the outermost edges of one or more of the vertical frame members 120, the bottom frame member 110, or the top frame member 130.

Referring again to FIGS. 3A-4, insulated panels 10 consistent with the present disclosure may further comprise an exterior water-resistant barrier 600 disposed on an exterior surface of the exterior sheathing layer 500. The exterior water-resistant barrier 600 may comprise, consist essentially of, or consist of any suitable water-resistant barrier material. For example and without limitation, the exterior water-resistant barrier 600 may comprise, consist essentially of, or consist of a non-woven water penetration resistant sheeting such as non-woven breathable air- and water-barrier sheet (e.g., TYVEK HOMEWRAP, DuPont).

As shown in FIGS. 3A-4, insulated panels 10 consistent with the present disclosure may also include an interior sheathing layer 700 disposed on an interior face of the core layer 400. The interior sheathing layer 700 may comprise, consist essentially of, or consist of any suitable sheathing (e.g., insulation) material. For example and without limitation, the interior sheathing layer 700 may comprise, consist essentially of, or consist of foam sheathing such as expanded polystyrene board (e.g., FOAMULAR, Owens Corning). Interior sheathing layer 700 may comprise, consist essentially of, or consist of single-ply continuous fiber board comprising softwood fiber, adhesive and Paraffin, and having an R-value of about 3/inch to about 4/inch, and optionally a vapor permeability rating of about 40 perm-inch to about 50 perm-inch (e.g., TimberBoard, TimberHP, Madison, ME). In some embodiments, the interior sheathing layer 700 has a thickness of about ⅛ inch to about 2 inches, for example about ⅛ inch, about ¼ inch, about ⅜ inch, about ½ inch, about ⅝ inch, about ¾ inch, about ⅞ inch, about 1 inch, about 1⅛ inches, about 1¼ inches, about 1⅜ inches, about 1½ inches, about 1⅝ inches, about 1¾ inches, about 1⅞ inches, or about 2 inches.

Referring now generally to FIGS. 7 and 10, the interior sheathing layer 700 in some embodiments is offset laterally and/or vertically from the core layer 400 such that the interior sheathing layer 700 extends beyond the one or more of the vertical frame members 120 and/or beyond the bottom frame member 110 and/or beyond the top frame member 130. In such embodiments, the interior sheathing layer 700 may have the same or substantially the same width w and height h as the core layer 400. In such embodiments, the insulated panel 10 may be configured to mate with a second insulated layer 10' that includes an interior sheathing layer 700' that does not extend to the outermost edges of one or more of the vertical frame members 120, the bottom frame member 110, or the top frame member 130.

In some embodiments, an insulated panel 10 consistent with the present disclosure provides substantially no or no structural enhancement to the preexisting structure wall. For example and without limitation, the load-bearing capacity of a multi-layer structural wall 15 including an installed insulated panel 10 consistent with the present disclosure may be the same or substantially the same as the load-bearing capacity of the structure wall without the insulated panel 10.

In some embodiments, the present disclosure provides an insulated panel 10 comprising: a core layer 400 comprising thermal insulation; an exterior layer 500 comprising sheathing; and an interior layer 700 disposed opposite the exterior layer and comprising sheathing. In some embodiments, the insulated panel 10 further comprises a water-resistant barrier layer 600 disposed on the exterior layer 500 opposite the core layer 400. In some embodiments, the core layer further comprises at least one horizontal frame member 300. In some embodiments, the core layer further comprises at least one vertical frame member 200. In some embodiments, at least one vertical frame member 200 extends above a top frame member 130 by a height h'. In some embodiments, the at least one vertical frame member 200 is configured to mate with an overhang channel OHC of a structure. In some embodiments, the insulated panel 10 further comprises a frame 100 disposed about an outer perimeter of the insulated panel. In some embodiments, the frame comprises a top frame member 130 and at least one vertical frame member 120. In some embodiments, the at least one vertical frame member 130 extends above the top frame member 130 by a height h'. In some embodiments, the at least one vertical frame member 200 is configured to mate with an overhang channel OHC of a structure. In some embodiments, the insulated panel is configured to be installed in direct contact with exterior sheathing ES of a structure. In some embodiments, the insulated panel is configured to receive fasteners anchoring at least one furr strips FS to an exterior surface of the insulated panel. In some embodiments, the insulated panel is configured to rest upon a panel support 1000. In some embodiments, the panel support 1000 is configured to be anchored to a foundation of the structure. In some embodiments, a bottom frame member 110 is configured to rest on the panel support 1000.

In some embodiments, the present disclosure provides an insulated panel 10 comprising: an external frame 100; a thermal insulation 400 disposed within the external frame 100; a first sheathing layer 700 disposed on an interior face of the insulated panel; a second sheathing layer 500 disposed on an exterior face of the insulated panel; and a water-resistant barrier layer 600 disposed on the second sheathing layer opposite the first sheathing layer. In some embodiments, the insulated panel 10 further comprises at least one interior frame member 200,300 disposed within the external frame 100. In some embodiments, the at least one interior frame member 200,300 comprises a vertical interior frame member 200. In some embodiments, the at least one interior frame member 200,300 comprises a horizontal interior frame member 300. In some embodiments, the external frame 100 comprises a bottom frame member 110, a first vertical frame member 120 disposed at one end of the bottom frame member, a second vertical frame member 120 disposed at a second end of the bottom frame member, and a top frame member 130 disposed opposite the bottom frame member. In some embodiments, the first and second vertical frame members 120 each extend above the top frame member by a height h'. In some embodiments, a vertical interior frame member 200, if present, extends above the top frame member by a height h'. In some embodiments, the insulated panel has a height h sufficient to extend from a rim joist of a structure to a soffit of the structure.

In some embodiments, the present disclosure provides an insulating core-shell construction panel comprising: a core 200,300,410 comprising thermal insulation component 410 and an internal frame component 200,300 dispersed throughout the thermal insulation component; and a shell surrounding the core and comprising: an external frame 100 surrounding a perimeter of the core and having an external face and an internal face opposite the external face, an external sheathing layer 500 disposed on the external face of the external frame, and an internal sheathing layer 700 disposed on the internal face of the external frame. In some embodiments, the thermal insulation component comprises, consists essentially of, or consists of any one or more of: extruded polystyrene, spray foam, woodfiber insulation batts, and stone wool batt. In some embodiments, the internal frame component represents not more than about 20% of a cross-sectional area of the core. In some embodiments, the internal frame component includes at least one horizontal internal frame member 300 and optionally at least one vertical internal frame member 200. In some embodiments, the external frame comprises a bottom frame member 110, at least one vertical frame member 120, and a top frame member 130. In some embodiments, the external sheathing layer comprises, consists essentially of, or consists of any one or more of: plywood, pressboard, oriented strand board, gypsum, glass mat, cement board, and long-fibered water- and weather-resistant engineered panels. In some embodiments, the internal sheathing layer comprises, consists essentially of, or consists of foam sheathing. In some embodiments, the internal sheathing layer 700 comprises, consists essentially of, or consists of single-ply continuous fiber board, such as single-ply continuous fiber board comprising softwood fiber, adhesive, and Paraffin, and having an R-value of about 3/inch to about 4/inch, and optionally a vapor permeability rating of about 40 perm-inch to about 50 perm-inch (e.g., TimberBoard, TimberHP, Madison, ME). In some embodiments, the shell further comprises a water-resistant barrier layer 600 disposed on an exterior face of the exterior sheathing layer. In some embodiments, the internal sheathing layer comprises a drainable sheathing portion 710 configured to enable moisture to exit the insulating core-shell construction panel from the core Referring again to FIGS. 3A-3B, installation of an insulated panel 10 on an existing structure may result in a multi-layer exterior structural wall 15 comprising, in order from interior space to exterior environment, interior gypsum board GB, preexisting home wall framing WF, preexisting interior vapor barrier VB, preexisting wall insulation WI, interior sheathing layer 700, core layer 400/thermal insulation segment(s) 410, exterior sheathing layer 500, exterior water-resistant barrier 600, furr strips FS, and exterior siding LS.

Figure 5:
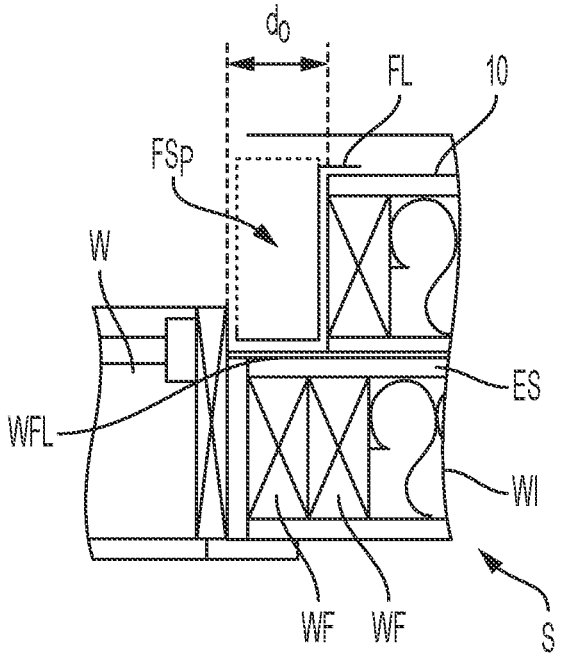
FIG. 5 shows an enlarged portion of an insulated panel consistent with the present disclosure installed at a window flange.

Referring now to FIG. 5, insulated panels 10 may be configured in some embodiments to provide an offset $d_o$ from an existing feature such as a door or window W when installed adjacent to window flashing WFL on an existing exterior sheathing layer ES of a structure S. The offset $d_o$ may be about 1 inch to about 4 inches, for example about 1 inch, about 1.25 inches, about 1.5 inches, about 1.75 inches, about 2 inches, about 2.25 inches, about 2.5 inches, about 2.75 inches, about 3 inches, about 3.25 inches, about 3.5 inches, about 3.75 inches, or about 4 inches. In some embodiments, the offset $d_o$ is bridged by one or more layers of flashing FL, such as flashing tape, roll-on flashing, or flashing membrane. After installation of the insulated panel 10 and flashing FL, the remaining gap may be filled with furring FSp, trim, or other fill material as desired.

Figure 6:
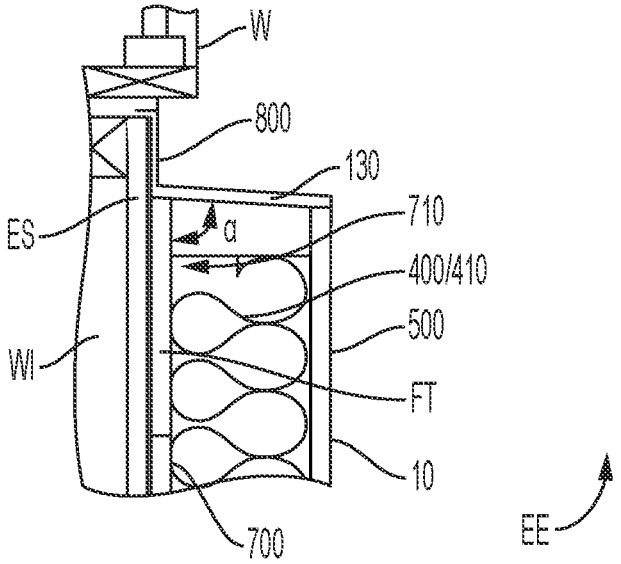
FIG. 6 shows an enlarged portion of the insulated panel of FIG. 3A-3B at a windowsill interface.

As shown representatively in FIG. 6, the interior sheathing layer 700 may include a drainable sheathing portion 710 disposed adjacent to the top frame member 130. When present, the drainable sheathing portion 710 may promote drainage of water into the core layer 400 and/or into the insulation 410. In such embodiments, a water-resistant barrier FT, such as a liquid water-resistant barrier, may be applied to the exterior sheathing ES before installation of the insulated panel 10, for example to prevent moisture from seeping into the exterior sheathing ES. In some embodiments, the top frame member 130 may be disposed at an angle $\alpha$ relative to the interior sheathing layer 700 or the drainable sheathing portion 710 (when present), for example to form a sloped top surface that promotes drainage from a window opening or windowsill. In some embodiments, the angle $\alpha$ is acute. in some embodiments, the angle $\alpha$ is about 75° to about 89.9°, for example about 75°, about 76°, about 77°, about 78°, about 79°, about 80°, about 81°, about 82°, about 83°, about 84°, about 85°, about 86°, about 87°, about 88°, about 89°, about 89.5°, or about 89.9°. In some embodiments, a flashing pan 800 is disposed (e.g., installed) adjacent to the top frame member 130 to further promote drainage of water away from the structure S and especially away from the interface between the insulated panel 10 and the external sheathing ES and/or applied flashing material FT.

Figure 8:
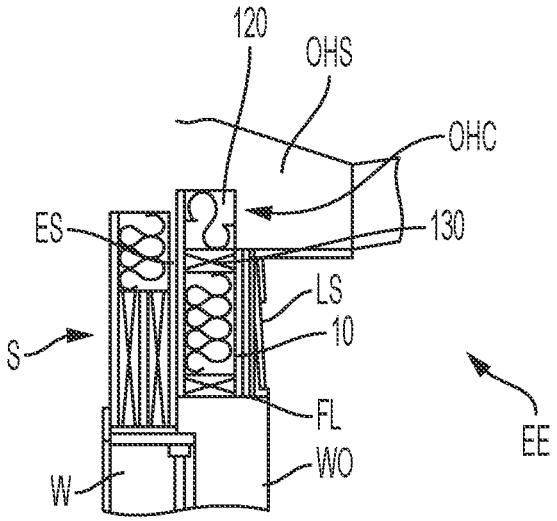
FIG. 8 shows an enlarged portion of the insulated panel of FIG. 3A-3B at a soffit interface.

FIG. 8 representatively shows an example installation of an insulated panel 10 including vertical frame members 120 extending above the top frame member 130 by a height h', similar to that shown in FIG. 2. During installation, the extended portions of the vertical frame members 120 are fed into overhead channels OHC in the overhead soffit OHS to further enhance thermal insulation of the structure S from heat exchange with the exterior environment EE.

Figure 9A:
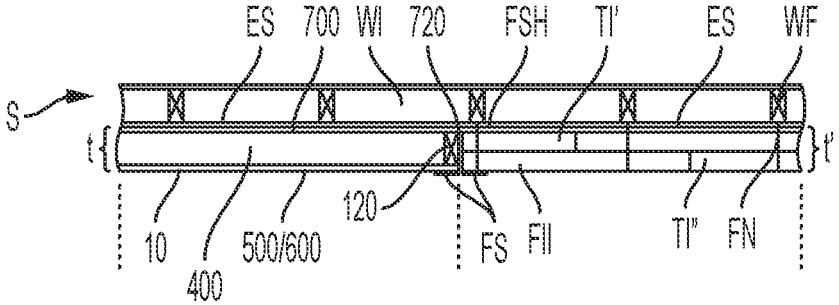
FIG. 9A shows a top-down cross-sectional view of a transition between field-installed insulation consistent with methods common in the prior art (right) and an installed insulated panel consistent with the present disclosure (left).
Figure 9B:
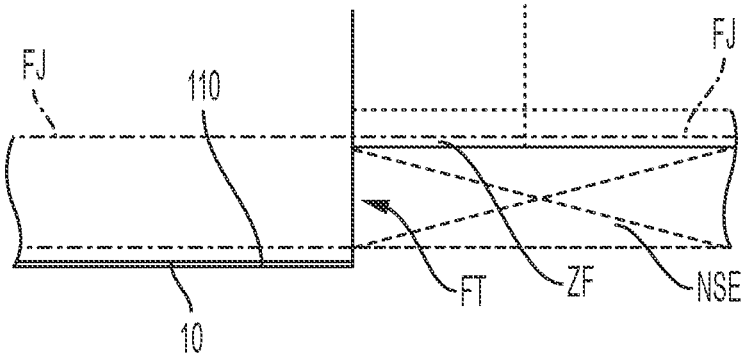
FIG. 9B shows an elevation plan view of the transition shown in FIG. 9A.

Referring now to FIGS. 9A-9B, insulated panels 10 consistent with the present disclosure may be installed adjacent to (e.g., forms a butt joint with) field-installed insulation FII (e.g., one or more layers of thermal insulation TI',TI" secured to the wood framing WF of the structure S by one or more fasteners FN) to minimize or even prevent moisture seepage between the insulated panels 10 and the exterior sheathing ES of the structure S. In some such embodiments, the insulated panel 10 is installed on the exterior sheathing ES such that the lateral edge 720 of the interior sheathing layer 700 is in contact with a foam sheathing layer FSH between the field-installed insulation FII and the exterior sheathing ES of the structure S. In some embodiments, the exposed lateral end of the field-installed insulation FII is first sealed, for example using a flashing tape, a liquid flashing material, or other water-resistant barrier product before the lateral edge 720 of the interior sheathing layer 700 is placed in contact with the exposed lateral edge of the foam sheathing FSH. As shown specifically in FIG. 9B, the field-installed insulation FII may be installed over a foam sheathing layer FSH such as expanded polystyrene (XPS) to manufacturer guidelines and over Z-flashing ZF and/or non-structural elements NSE at portions of the structure S where insulated panels 10 are not necessary or convenient to install. The resulting combination of field-installed insulation FII and insulated panels 10 should provide a continuous or substantially continuous outer surface profile (e.g., the thickness t of the insulated panel 10 adjacent to the field-installed insulation FII should be the same as or substantially the same as the thickness t' of the combination of the field-installed insulation FII and the additional foam sheathing FSH installed over the exterior sheathing ES of the structure S).

Figure 11:
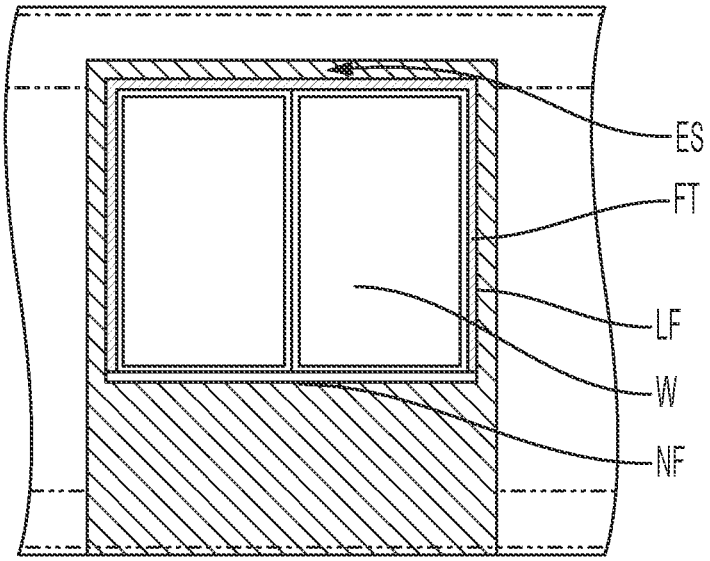
FIG. 11 shows a representative method of pretreating exterior sheathing of a structure before installation of an insulated panel consistent with one embodiment of the present disclosure.
Figure 12:
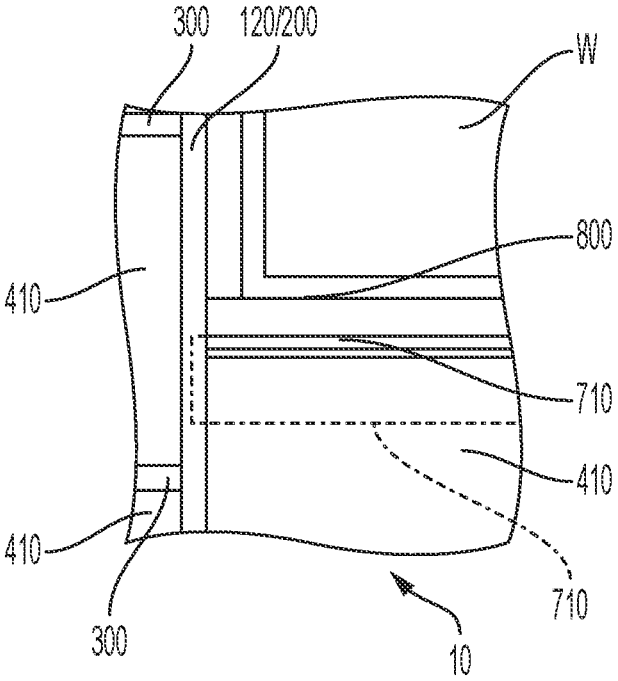
FIG. 12 shows a flashing pan configured to enhance moisture removal between an insulated panel and a structure consistent with one embodiment of the present disclosure.
Figure 13:
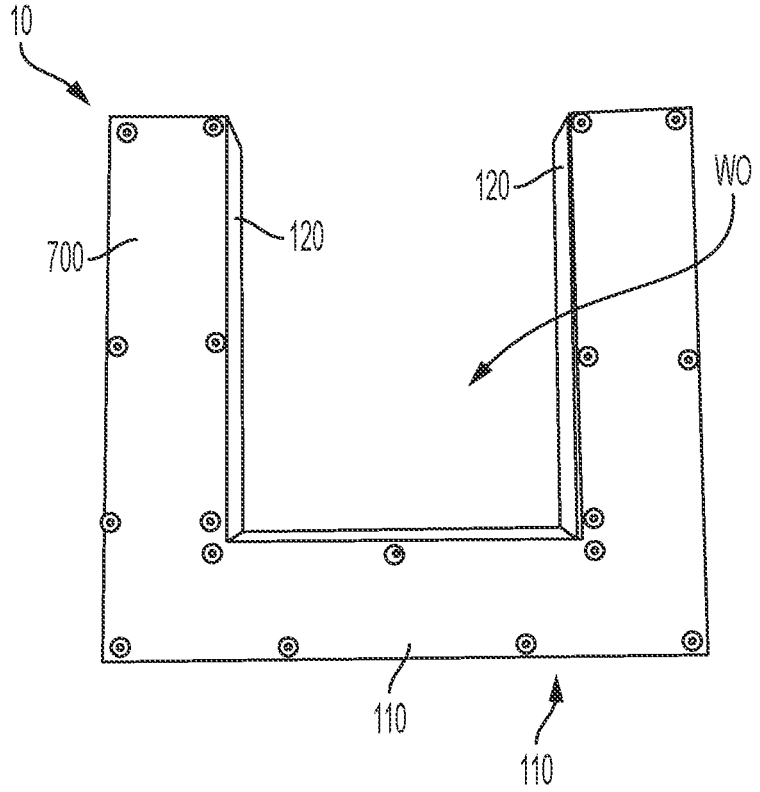
FIG. 13 shows an insulated panel including a window opening consistent with one embodiment of the present disclosure.
Figure 14:
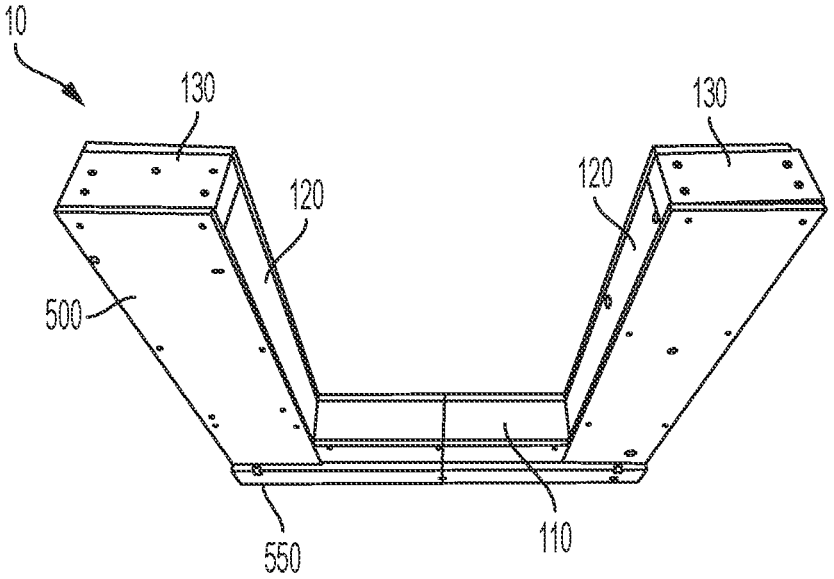
FIG. 14 shows the exterior side of the insulated panel of FIG. 13.
Figure 15:
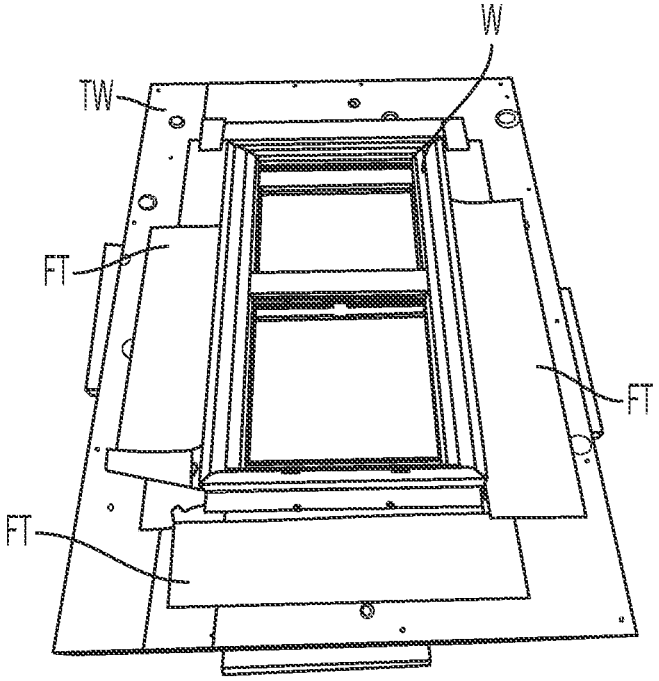
FIG. 15 shows a window of a representative structure pretreated to receive the insulated panel of FIG. 13.

FIGS. 11-12 representatively show additional optional installation steps for further enhancing thermal insulation performance of insulated panels 10 consistent with the present disclosure when installed around openings in the structure S, such as windows W. In some embodiments, existing sheathing ES around an installed window W may be enhanced by applying a water-resistant barrier, for example in the form of flashing tape FT such as flashing tape having a width of about 4 inches to about 8 inches (e.g., 6 inches). In some embodiments, the bottom nailing flange NF is left uncovered by flashing tape FT to promote drainage of moisture from the window W. In some embodiments, liquid flashing LF is applied to edges of the existing sheathing ES and the top nailing flange (not labeled). As shown representatively in FIG. 12, a flashing pan 800 may be installed on the sill of the window W and over the top frame 130 of the insulated panels 10 to promote drainage over (but not into) the insulated panels 10. In some embodiments, the interior sheathing layer 700 includes a drainable sheathing segment 710 disposed at or near the top frame 130 such that water preferentially flows into the insulated panel 10 (e.g., into the core layer 400 and/or into the thermal insulation 410) rather than into the existing structure S. In some embodiments, the drainable sheathing segment 710 extends to the top edge of the interior sheathing layer 700. Without wishing to be bound by theory, it is currently believed that water seeping into the insulated panel 10 through the drainable sheathing segment 710 will disperse and dissipate to the exterior environment EE faster and/or more thoroughly, and/or mold and mildew formation in the walls of the existing structure S will be attenuated, than if the same amount of water seeps into the walls (e.g., into the wall insulation WI) of the existing structure S instead.

In some embodiments, a structure wall 15 including an insulated panel 10 consistent with the present disclosure has a substantially greater thermal insulation rating than the structure wall without the insulated panel 10. For example and without limitation, a structure wall 15 including an insulated panel 10 consistent with the present disclosure may in some embodiments have an added insulation value (e.g., an added R-value) of at least about R-10, for example at least about R-10, at least about R-11, at least about R-12, at least about R-13, at least about R-14, at least about R-15, at least about R-16, at least about R-17, at least about R-18, at least about R-19, at least about R-20, at least about R-21, at least about R-22, at least about R-23, at least about R-24, at least about R-25, at least about R-26, at least about R-27, at least about R-28, at least about R-29, at least about R-30, or greater than an R-30 added insulation value.

In some embodiments, structure walls 15 including an insulated panel 10 consistent with the present disclosure does not experience a significant gain in moisture over a time period of at least one year, for example at least one year, at least 2 years, at least 3 years, at least 4 years, at least 5 years, at least 6 years, at least 7 years, at least 8 years, at least 9 years, at least 10 years, or more than 10 years.

In some embodiments, a structure wall 15 including an insulated panel 10 consistent with the present disclosure has a substantially greater thermal insulation rating without an increased incidence of mildew or mold formation compared to the structure wall without the insulated panel 10. In some embodiments, the structure wall 15 is configured to prevent the internal temperature of the wall or insulated panel 10 from dropping below the dewpoint for at least one year after installation of the insulated panel 10, for example for at least one year, for at least 2 years, for at least 3 years, for at least 4 years, for at least 5 years, for at least 6 years, for at least 7 years, for at least 8 years, for at least 9 years, for at least 10 years, or for more than 10 years after installation of the insulated panel 10 to form the structure wall 15.

In some embodiments, the present disclosure provides a method of enhancing thermal insulation performance of a wall, the method comprising: removing an exterior siding layer and associated furr strips, if present, to expose an existing exterior sheathing layer of the wall; attaching an insulated panel 10 as disclosed herein or an insulating core-shell construction panel as disclosed herein to the existing exterior sheathing of the wall; and attaching an exterior siding layer to an exterior surface of the insulated panel or the insulating core-shell construction panel. In some embodiments, the method further comprises anchoring a panel support 1000 to the wall or to a foundation supporting the wall. In some embodiments, the step of attaching comprises resting the insulated panel 10 or the insulating core-shell construction panel 10 on the panel support. In some embodiments, the thermal insulation rating of the wall in increased by an added insulation value (e.g., an added R-value) of at least about R-10, for example at least about R-10, at least about R-11, at least about R-12, at least about R-13, at least about R-14, at least about R-15, at least about R-16, at least about R-17, at least about R-18, at least about R-19, at least about R-20, at least about R-21, at least about R-22, at least about R-23, at least about R-24, at least about R-25, at least about R-26, at least about R-27, at least about R-28, at least about R-29, at least about R-30, or greater than an R-30 added insulation value.

EXAMPLES

Example 1

As shown in FIGS. 13-17, an insulated panel 10 consistent with the present disclosure and including a void WO sized to fit in close proximity to the exterior dimensions of a window W was prepared including extruded polystyrene board as the interior sheathing layer 700; pine lumber (2×4 nominal dimension) as frame members 110,120,130; a single layer of 3.5-inch thick R15-rated mineral wool batt insulation (Comfortbatt, Rockwool; Milton, Ontario) as thermal insulation 410 (not shown); ½-inch plywood as exterior sheathing layer 500, and TYVEK HOMEWRAP as exterior water-resistant barrier 600. A rainscreen vent 550 (SV-3, Cor-A-Vent, Inc.) was disposed on the exterior sheathing layer 500 near the bottom frame member 110.

The U-shaped insulated panel 10 was installed around an exterior portion of a window W in a test wall TW that had been first prepared by adhering about one inch of the width of flashing tape FT to the test wall TW immediately adjacent to the edges of the window W (FIG. 16). After the insulated panel 10 was secured in place (FIG. 16), the remaining portions of the flashing tape FT were adhered to the frame members 120 and exterior sheathing layer 500 of the insulated panel 10. The exterior water-resistant barrier 600 was then installed over the exterior sheathing layer 500 and the portions of flashing tape FT.

Figure 18:
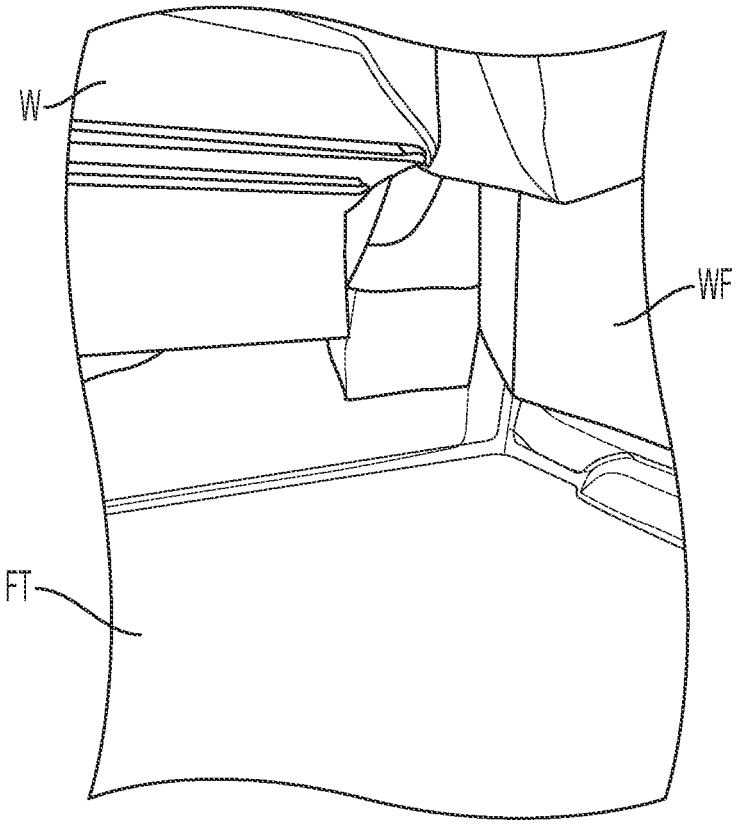
FIG. 18 shows an enlarged view of a framed window opening including flashing membrane installed over the insulated panel of FIG. 17.
Figure 19:
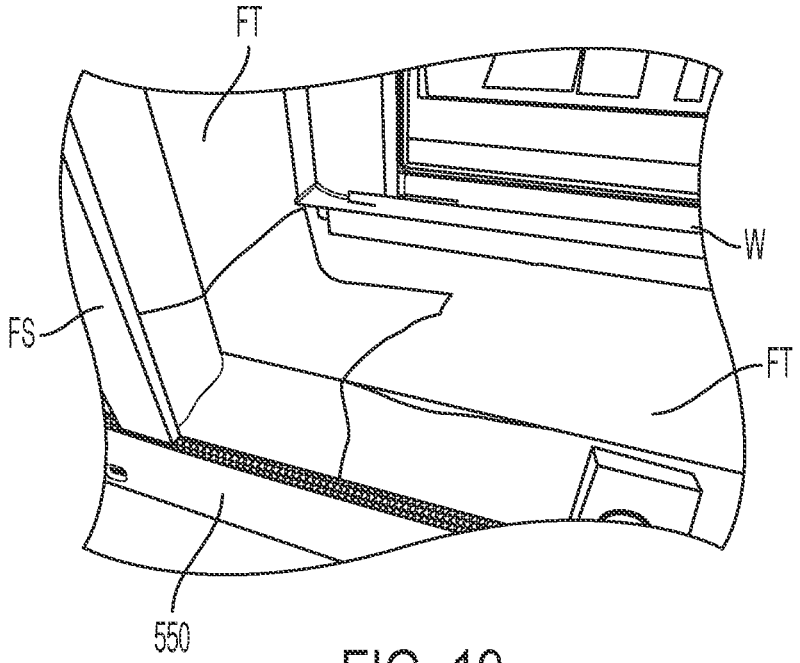
FIG. 19 shows an enlarged view of a framed window opening including flashing membrane and supplemental corner flashing installed over the insulated panel of FIG. 17.
Figure 20:
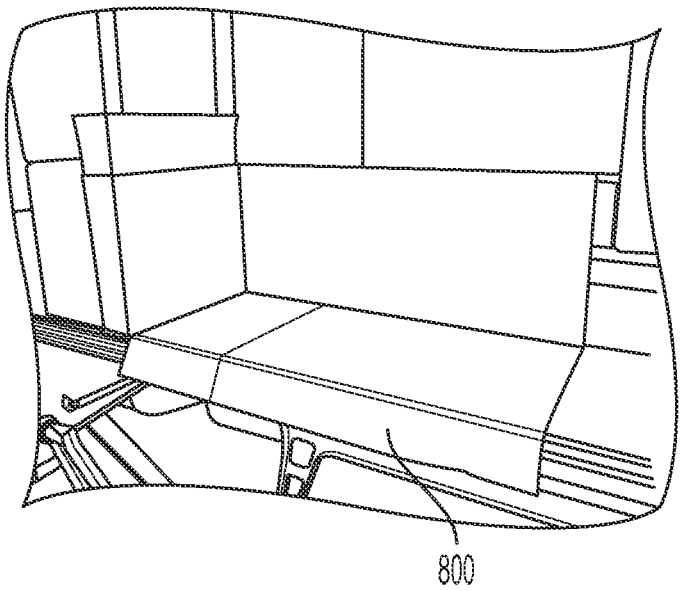
FIG. 20 shows an enlarged view of a template representing a portion of a flashing membrane to be installed over the insulated panel of FIG. 17.

The loose flaps of the flashing tape FT were then adhered to the components of the frame 100 as shown in FIGS. 18-19. A flashing pan 800 was then installed over the flashing tape FT to enhance water drainage away from the walls of the structure S and over the insulated panel 10 (FIG. 20 shows a paper template representing the flashing pan 800).

Example 2

An insulated panel 10 consistent with the present disclosure is prepared including single-ply continuous fiber board comprising softwood fiber, adhesive, and Paraffin, and having an R-value of about 3.4/inch to about 3.7/inch, and a vapor permeability rating of about 44 perm-inch (TimberBoard, TimberHP, Madison, ME) as the interior sheathing layer 700; pine lumber (2×4 nominal dimension) as frame members 110,120,130; a single layer of 3.5-inch thick R15-rated mineral wool batt insulation (Comfortbatt, Rockwool; Milton, Ontario) as thermal insulation 410 (not shown); ½-inch plywood as exterior sheathing layer 500, and TYVEK HOMEWRAP as exterior water-resistant barrier 600. A rainscreen vent 550 (SV-3, Cor-A-Vent, Inc.) is disposed on the exterior sheathing layer 500 near the bottom frame member 110.

FURTHER EXAMPLES

Further Example 1. An insulated panel (10) comprising:
- a core layer (400) comprising thermal insulation;
- an exterior layer (500) comprising sheathing; and
- an interior layer (700) disposed opposite the exterior layer and comprising sheathing or single-ply continuous fiber board.

Further Example 2. The insulated panel of Further Example 1 further comprising a water-resistant barrier layer (600) disposed on the exterior layer (500) opposite the core layer (400).

Further Example 3. The insulated panel of Further Example 1 or Further Example 2, wherein the core layer further comprises at least one horizontal frame member (300).

Further Example 4. The insulated panel of any one preceding Further Example, wherein the core layer further comprises at least one vertical frame member (200).

Further Example 5. The insulated panel of Further Example 4, wherein at least one vertical frame member (200) extends above a top frame member (130) by a height h'.

Further Example 6. The insulated panel of Further Example 5, wherein the at least one vertical frame member (200) is configured to mate with an overhang channel (OHC) of a structure.

Further Example 7. The insulated panel of any one preceding Further Example further comprising a frame (100) disposed about an outer perimeter of the insulated panel.

Further Example 8. The insulated panel of Further Example 7, wherein the frame comprises a top frame member (130) and at least one vertical frame member (120).

Further Example 9. The insulated panel of Further Example 8, wherein the at least one vertical frame member (120) extends above the top frame member (130) by a height h'.

Further Example 10. The insulated panel of Further Example 9, wherein the at least one vertical frame member (200) is configured to mate with an overhang channel (OHC) of a structure.

Further Example 11. The insulated panel of any one preceding Further Example, wherein the insulated panel is configured to be installed in direct contact with exterior sheathing (ES) of a structure.

Further Example 12. The insulated panel of any one preceding Further Example, wherein the insulated panel is configured to receive fasteners anchoring at least one furr strips (FS) to an exterior surface of the insulated panel.

Further Example 13. The insulated panel of any one preceding Further Example, wherein the insulated panel is configured to rest upon a panel support (1000).

Further Example 14. The insulated panel of Further Example 13, wherein the panel support (1000) is configured to be anchored to a foundation of the structure.

Further Example 15. The insulated panel of Further Example 14, wherein a bottom frame member (110) is configured to rest on the panel support (1000).

Further Example 16. An insulated panel (10) comprising:
- an external frame (100);
- a thermal insulation (400) disposed within the external frame (100);
- a first sheathing layer (700) disposed on an interior face of the insulated panel;
- a second sheathing layer (500) disposed on an exterior face of the insulated panel; and
- a water-resistant barrier layer (600) disposed on the second sheathing layer opposite the first sheathing layer.

Further Example 17. The insulated panel of Further Example 16 further comprising at least one interior frame member (200,300) disposed within the external frame (100).

Further Example 18. The insulated panel of Further Example 17, wherein the at least one interior frame member (200,300) comprises a vertical interior frame member (200).

Further Example 19. The insulated panel of Further Example 17 or Further Example 18, wherein the at least one interior frame member (200,300) comprises a horizontal interior frame member (300).

Further Example 20. The insulated panel of any one of Further Examples 16-19, wherein the external frame (100) comprises a bottom frame member (110), a first vertical frame member (120) disposed at one end of the bottom frame member, a second vertical frame member (120) disposed at a second end of the bottom frame member, and a top frame member (130) disposed opposite the bottom frame member.

Further Example 21. The insulated panel of Further Example 20, wherein the first and second vertical frame members (120) each extend above the top frame member by a height h'.

Further Example 22. The insulated panel of Further Example 20 or Further Example 21, wherein a vertical interior frame member (200), if present, extends above the top frame member by a height h'.

Further Example 23. The insulated panel of any one preceding Further Example, wherein the insulated panel has a height h sufficient to extend from a rim joist of a structure to a soffit of the structure.

Further Example 24. An insulating core-shell construction panel (10) comprising:
- a core (200,300,410) comprising thermal insulation component (410) and an internal frame component (200, 300) dispersed throughout the thermal insulation component; and
- a shell surrounding the core and comprising:
  - an external frame (100) surrounding a perimeter of the core and having an external face and an internal face opposite the external face,
  - an external sheathing layer (500) disposed on the external face of the external frame, and
  - an internal sheathing layer (700) disposed on the internal face of the external frame.

Further Example 25. The insulating core-shell construction panel of Further Example 24, wherein the thermal insulation component comprises, consists essentially of, or consists of any one or more of: extruded polystyrene, spray foam, woodfiber insulation batts, and stone wool batt.

Further Example 26. The insulating core-shell construction panel of Further Example 24 or Further Example 25, wherein the internal frame component represents not more than about 20% of a cross-sectional area of the core.

Further Example 27. The insulating core-shell construction panel of any one of Further Examples 24-26, wherein the internal frame component includes at least one horizontal internal frame member (300) and optionally at least one vertical internal frame member (200).

Further Example 28. The insulating core-shell construction panel of any one of Further Examples 24-27, wherein the external frame comprises a bottom frame member (110), at least one vertical frame member (120), and a top frame member (130).

Further Example 29. The insulating core-shell construction panel of any one of Further Examples 24-28, wherein the external sheathing layer comprises, consists essentially of, or consists of any one or more of: plywood, pressboard, oriented strand board, gypsum, glass mat, cement board, and long-fibered water- and weather-resistant engineered panels.

Further Example 30. The insulating core-shell construction panel of any one of Further Examples 24-29, wherein the internal sheathing layer comprises, consists essentially of, or consists of foam sheathing.

Further Example 31. The insulating core-shell construction panel of any one of Further Examples 24-30, wherein the internal sheathing layer comprises, consists essentially of, or consists of single-ply continuous fiberboard.

Further Example 32. The insulating core-shell construction panel of any one of Further Example 24-31, wherein the shell further comprises a water-resistant barrier layer (600) disposed on an exterior face of the exterior sheathing layer.

Further Example 33. The insulating core-shell construction panel of any one of Further Examples 24-32, wherein the internal sheathing layer comprises a drainable sheathing portion (710) configured to enable moisture to exit the insulating core-shell construction panel from the core.

Further Example 34. A method of enhancing thermal insulation performance of a wall, the method comprising:

removing an exterior siding layer and associated furr strips, if present, to expose an existing exterior sheathing layer of the wall;

attaching an insulated panel (10) of any one of Further Examples 1-23 or an insulating core-shell construction panel (10) of any one of Further Examples 24-33 to the existing exterior sheathing of the wall; and attaching an exterior siding layer to an exterior surface of the insulated panel or the insulating core-shell construction panel.

Further Example 35. The method of Further Example 34 further comprising anchoring a panel support (1000) to the wall or to a foundation supporting the wall.

Further Example 36. The method of Further Example 35, wherein the step of attaching comprises resting the insulated panel (10) of any one of Further Examples 1-23 or the insulating core-shell construction panel (10) of any one of Further Examples 24-33 on the panel support.

Further Example 37. The method of any one of Further Examples 34-36, wherein a thermal insulation rating of the wall in increased by an added insulation value (e.g., an added R-value) of at least about R-10, for example at least about R-10, at least about R-11, at least about R-12, at least about R-13, at least about R-14, at least about R-15, at least about R-16, at least about R-17, at least about R-18, at least about R-19, at least about R-20, at least about R-21, at least about R-22, at least about R-23, at least about R-24, at least about R-25, at least about R-26, at least about R-27, at least about R-28, at least about R-29, at least about R-30, or greater than an R-30 added insulation value.

What is claimed is:

1. An insulated panel comprising:

a frame disposed about an outer perimeter of the insulated panel, the frame having a first height (h) of about 4 feet to about 12 feet and being defined by opposing first and second vertical frame members interconnected with top and bottom horizontal frame members, wherein the bottom horizontal frame member is configured to rest on a panel support;

a core layer disposed within the frame, the core layer comprising thermal insulation;

an exterior layer disposed on an exterior side of the core layer, the exterior layer comprising a first sheathing;

an interior layer disposed on an interior side of the core layer, the interior layer comprising a second, insulating sheathing or single-ply continuous fiber board; and a water-resistant barrier layer disposed on the exterior layer opposite the core layer.

2. The insulated panel of claim 1, wherein the insulated panel is configured to be installed in direct contact with existing exterior sheathing of a structure.

3. The insulated panel of claim 1, wherein at least one of the vertical frame members extends above the top frame member by a second height (h').

4. The insulated panel of claim 3, wherein the at least one vertical frame member is configured to mate with an overhang channel of a structure.

5. The insulated panel of claim 1, wherein the insulated panel is configured to rest upon the panel support.

6. The insulated panel of claim 5, wherein the panel support is configured to be anchored to a foundation of a structure.

7. An insulated panel comprising:

an external frame, the external frame comprises a bottom frame member, a first vertical frame member disposed at one end of the bottom frame member, a second vertical frame member disposed at a second end of the bottom frame member, and a top frame member disposed opposite the bottom frame member;

a thermal insulation disposed within the external frame;

a first sheathing layer disposed on an interior face of the insulated panel;

a second sheathing layer disposed on an exterior face of the insulated panel; and a water-resistant barrier layer disposed on the second sheathing layer opposite the first sheathing layer, wherein the insulated panel has a height (h) configured to extend from a rim joist of a structure to a soffit of the structure.

8. The insulated panel of claim 7 further comprising at least one interior frame member disposed within the external frame.

9. The insulated panel of claim 8, wherein at least one of the at least one interior frame member comprises a vertical interior frame member or a horizontal interior frame member.

10. A method of enhancing thermal insulation performance of a wall, the method comprising:

removing an exterior siding layer and associated furr strips, if present, to expose an existing exterior sheathing layer of the wall;

attaching the insulated panel of claim 1 to the existing exterior sheathing of the wall; and attaching an exterior siding layer to an exterior surface of the insulated panel or an exterior surface of an insulating core-shell construction panel.

11. The method of claim 10, wherein a thermal insulation rating of the wall in increased by an added insulation value of at least one of about R-10, about R-11, about R-12, about R-13, about R-14, about R-15, about R-16, about R-17, about R-18, about R-19, about R-20, about R-21, about R-22, about R-23, about R-24, about R-25, about R-26, about R-27, about R-28, about R-29, or about R-30.

12. The method of claim 10 further comprising anchoring a panel support to the wall or to a foundation supporting the wall.

13. The method of claim 12, wherein the step of attaching comprises resting the insulated panel on the panel support.

* * * * *